US009208976B2

(12) United States Patent
Girlando et al.

(10) Patent No.: US 9,208,976 B2
(45) Date of Patent: Dec. 8, 2015

(54) DISCONNECTOR, PARTICULARLY OF THE DOUBLE-BREAK DOUBLE-MOVEMENT TYPE

(75) Inventors: Vincenzo Girlando, Padua (IT); Antonio Moro, Noventa di Piave (IT)

(73) Assignee: ALSTOM TECHNOLOGY LTD (CH)

( * ) Notice: Subject to any disclaimer, the term of this patent is extended or adjusted under 35 U.S.C. 154(b) by 246 days.

(21) Appl. No.: 13/809,944

(22) PCT Filed: Jun. 15, 2011

(86) PCT No.: PCT/EP2011/059913

§ 371 (c)(1),
(2), (4) Date: Jan. 14, 2013

(87) PCT Pub. No.: WO2012/007243

PCT Pub. Date: Jan. 19, 2012

(65) Prior Publication Data

US 2013/0118874 A1 May 16, 2013

(30) Foreign Application Priority Data

Jul. 12, 2010 (IT) ..... PD2010A0217

(51) Int. Cl.

| | |
|---|---|
| ***H01H 31/02*** | (2006.01) |
| ***H01H 31/28*** | (2006.01) |
| ***H01H 31/32*** | (2006.01) |
| ***H01H 31/16*** | (2006.01) |
| *H01H 1/36* | (2006.01) |
| *H01H 1/38* | (2006.01) |
| *H01H 1/44* | (2006.01) |
| *H01H 1/52* | (2006.01) |

(52) U.S. Cl.

CPC ..... *H01H 31/16* (2013.01); *H01H 31/023* (2013.01); *H01H 1/365* (2013.01); *H01H 1/38* (2013.01); *H01H 1/44* (2013.01); *H01H 1/52* (2013.01)

(58) Field of Classification Search

CPC ..... H01H 31/00; H01H 31/003; H01H 31/02; H01H 1/38; H01H 1/44

USPC ... 200/48 R, 48 A, 48 SB, 48 P, 48 KB, 48 V, 200/48 CB

See application file for complete search history.

(56) References Cited

U.S. PATENT DOCUMENTS 3,134,865 A 5/1964 Bernatt (Continued)

OTHER PUBLICATIONS

International Search Report for corresponding application PCT/EP2011/059913 filed on Jun. 15, 2011, Mail date Oct. 4, 2011.

(Continued)

*Primary Examiner* — Renee Luebke
*Assistant Examiner* — Lheiren Mae A Caroc
(74) *Attorney, Agent, or Firm* — Cantor Colburn LLP

(57) ABSTRACT

A disconnector, including a crossmember, which has contact pins at its opposite ends, C-shaped contact sockets, which are aligned so as to correspond to the pins in order to receive them by insertion, along a trajectory that is circumferential with respect to a first rotation axis of the crossmember, which is substantially transverse thereto, a support of the crossmember that defines for it the first rotation axis, and a second rotation axis, which is substantially longitudinal to the crossmember, elements for the rotation of the crossmember about the first rotation axis and about the second rotation axis, where fixed contacts are connected electrically, in two separate regions, to supporting arms that belong to the sockets, and have a portion that is intermediate with respect to the two regions, is adapted for contact with the moving contacts, and divides the fixed contacts into two opposite conducting arms.

10 Claims, 8 Drawing Sheets

(56) References Cited

U.S. PATENT DOCUMENTS

| | | | | |
|---|---|---|---|---|
| 3,388,225 | A * | 6/1968 | Foti | 200/48 A |
| 3,705,279 | A | 12/1972 | Kerr | |
| 4,379,956 | A * | 4/1983 | Cleaveland et al. | 200/48 A |
| 6,570,117 | B2 * | 5/2003 | Demissy et al. | 200/48 A |

OTHER PUBLICATIONS

Written Opinion for corresponding application PCT/EP2011/059913 filed on Jun. 15, 2011, Mail date Oct. 4, 2011.
Italian Search Report for corresponding IT application PD20100217 filed on Jul. 12, 2010, completion date Feb. 21, 2011.

* cited by examiner

DISCONNECTOR, PARTICULARLY OF THE DOUBLE-BREAK DOUBLE-MOVEMENT TYPE

TECHNICAL FIELD

The present invention relates to a disconnector, particularly of the double-break double-movement type.

BACKGROUND ART

Currently, in the field of post-type disconnectors, those that have a pillar that supports a crossmember so that it can rotate about a first rotation axis, which is transverse to the crossmember, and about a second rotation axis, which is longitudinal to the crossmember, are known.

The crossmember, at its ends, has contact pins that are adapted to engage in contact sockets of the electrical line that the disconnector is adapted to break.

The sockets are aligned with the pins along a trajectory that is circumferential with respect to the first rotation axis.

A mechanism for driving the crossmember actuates the sequential rotation about the first rotation axis and therefore about the second rotation axis or vice versa respectively in the closing and opening steps of the disconnector.

Thus, when the disconnector is open, the crossmember has its pins disengaged from the sockets and the crossmember is rotated with respect to such sockets, in an uncoupling configuration.

When the disconnector is closed, the crossmember rotates about the first rotation axis until the pins engage in the sockets.

Thus, the crossmember is rotated about the second rotation axis so that the pins rotate in the sockets from an uncoupling configuration to a coupling configuration, in which the pins interfere with the sockets so as to provide electrical contact with them.

The pins have contacts, which are termed moving contacts because they are moved with the crossmember during the closing and opening of the disconnector.

Likewise, the sockets have contacts that are termed fixed contacts.

More particularly, the sockets are substantially C-shaped and are provided internally with respectively facing fixed contacts.

Such contacts are provided by means of conducting elements that are folded into an arc-like shape and have one end that is fixed to the body of the socket and the other end that is kept divaricated from the first end by means of a spring.

Their central curved portion is oriented so as to receive the moving contacts of the pins when they enter the sockets.

Today it is known that this type of disconnector has limits as to the intensity of the electrical current that they can conduct that currently cannot be exceeded with known structures.

By using currently known disconnectors it is substantially not possible to obtain conduction of electricity with an intensity of more than 4000 A.

In order to approach these intensities of current to be conducted, operators in the field have devised socket structures that have facing racks of C-shaped fixed contacts, so as to make available to the electrical current to be conducted a plurality of parallel paths to pass from the sockets to the crossmember by means of the pins.

However, the reactance effect that is established between the fixed contacts of the same rack induces the electrical current to flow substantially only along the first fixed contacts, which are thus affected by high current intensity values, such current being conducted substantially regardless of the total number of fixed contacts that compose their same rack.

In this manner, the advantage of adding fixed contacts to the rack in order to have a larger number of paths for conducting the electrical current from the sockets to the crossmember is substantially eliminated.

Today, therefore, no electrical disconnectors of the described type that can be used in lines requiring a current conductivity of more than 4000 A are available.

DISCLOSURE OF THE INVENTION

The aim of the present invention is to provide a disconnector, particularly of the double-break double-movement type, that allows to conduct electrical currents with intensities even higher than 4000 A.

Within this aim, an object of the present invention is to provide a disconnector that allows effective and stable electrical connection between its pins and its sockets.

Another object of the invention is to provide a disconnector that has a durable efficiency.

Another object of the invention is to provide a disconnector which, when it is not disconnecting the line, allows an effective and efficient conduction of current across it.

Another object of the invention is to provide a disconnector that is durable over time, requiring infrequent maintenance interventions.

This aim, as well as these and other objects that will become better apparent hereinafter, are achieved by a disconnector, particularly of the double-break double-movement type, comprising a crossmember, which has the contact pins at its opposite ends, C-shaped contact sockets, which are aligned so as to correspond to said pins in order to receive them by insertion, along a trajectory that is circumferential with respect to a first rotation axis of said crossmember, which is substantially transverse thereto, a support of said crossmember that defines for it said first rotation axis, and a second rotation axis, which is substantially longitudinal to said crossmember, means for the rotation of said crossmember about said first rotation axis in order to drive the transition of said pins from a disengagement configuration to an engagement configuration in said sockets and vice versa, and about said second rotation axis in order to drive the transition of said pins from an uncoupling configuration to a coupling configuration of moving contacts of said pins with fixed contacts of said sockets, and vice versa, characterized in that said fixed contacts are connected electrically, in two separate regions, to the supporting arms that belong to said sockets, said fixed contacts having a portion that is intermediate with respect to said two regions and is adapted for contact with said moving contacts, said intermediate contact portion dividing said fixed contacts into two opposite conducting arms adapted to conduct electrical currents having a substantially equal intensity.

BRIEF DESCRIPTION OF THE DRAWINGS

Further characteristics and advantages of the invention will become better apparent from the following detailed description of a preferred but not exclusive embodiment of the disconnector according to the invention, illustrated by way of non-limiting example in the accompanying drawings, wherein.

WAYS OF CARRYING OUT THE INVENTION

Figure 1:
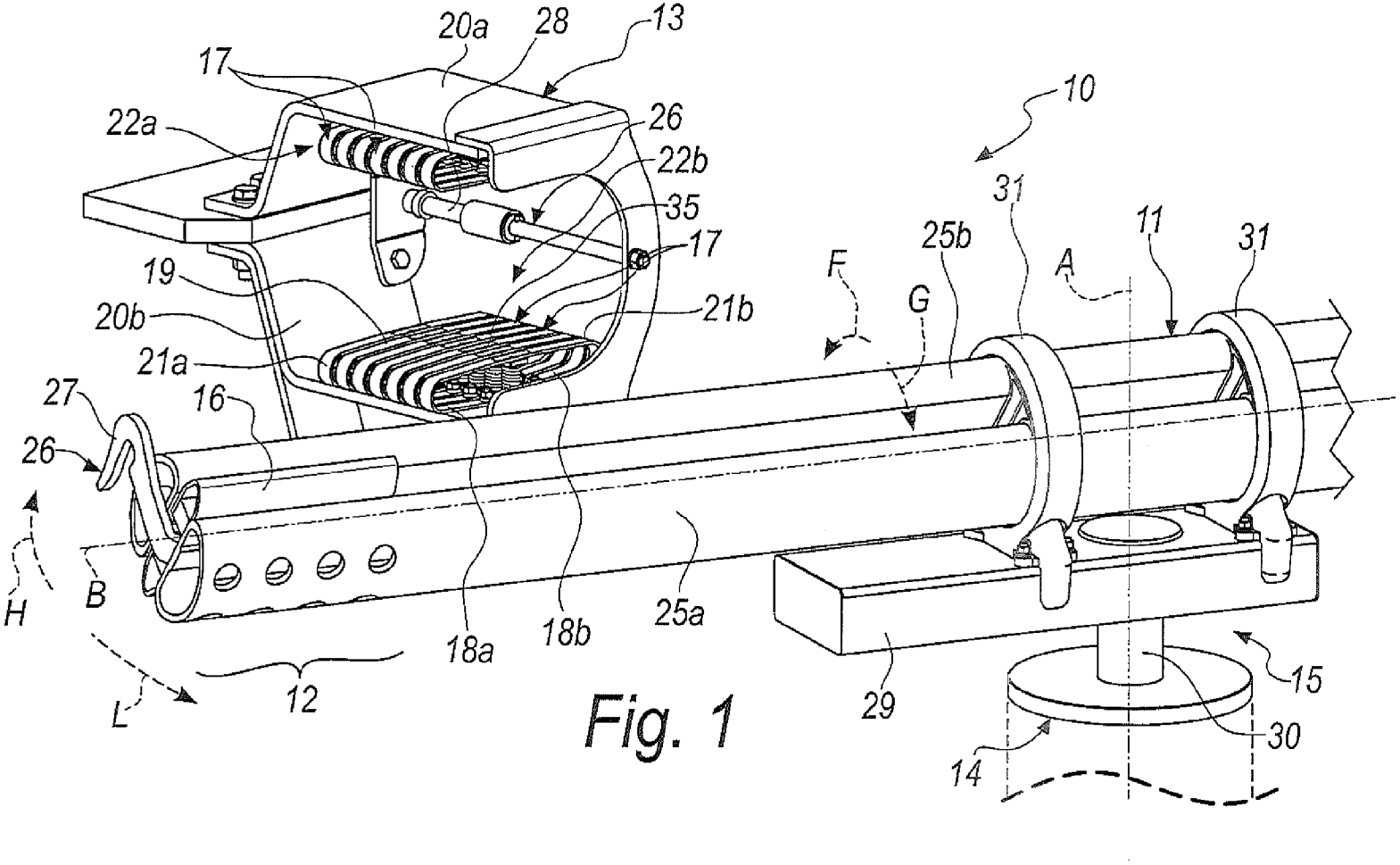
FIG. 1 is a perspective view of a part of a disconnector according to the invention.

It is noted that anything found to be already known during the patenting process is understood not to be claimed and to be the subject of a disclaimer.

With reference to the figures, the reference numeral 10 generally designates a disconnector, particularly of the double-break double-movement type, which comprises a crossmember 11, which has contact pins 12 at its opposite ends, C-shaped contact sockets 13, which are aligned at the pins 12, in order to receive them by insertion along a trajectory that is circumferential with respect to a first rotation axis A of the crossmember 11, which is substantially transverse thereto, a support 14 for the crossmember 11, which forms for such crossmember the first rotation axis A, and a second rotation axis B, which is substantially longitudinal to the crossmember 11, means 15 for the rotation of the crossmember 11 about the first rotation axis A, in order to drive the transition of the pins 12 from a disengagement configuration to a configuration of engagement in the sockets 13 and vice versa, and about the second rotation axis B, in order to drive the transition of the pins 12 from an uncoupling arrangement to an arrangement for the coupling of moving contacts 16 of the pins 12 with fixed contacts 17 of the sockets 13, and vice versa.

According to the invention, the disconnector 10 has a particularity in that the fixed contacts 17 are connected electrically, in two separate regions 18*a* and 18*b*, which are conveniently end regions, to supporting arms 20*a* and 20*b* that belong to the sockets 13.

The fixed contacts 17 have, between the two regions 18*a* and 18*b*, an intermediate portion 19 that is adapted for electrical contact with the moving contacts 16 and divides the fixed contacts 17 into two opposite conducting arms 21*a* and 21*b* that are adapted to conduct electrical currents of substantially equal intensity.

Figure 3A:
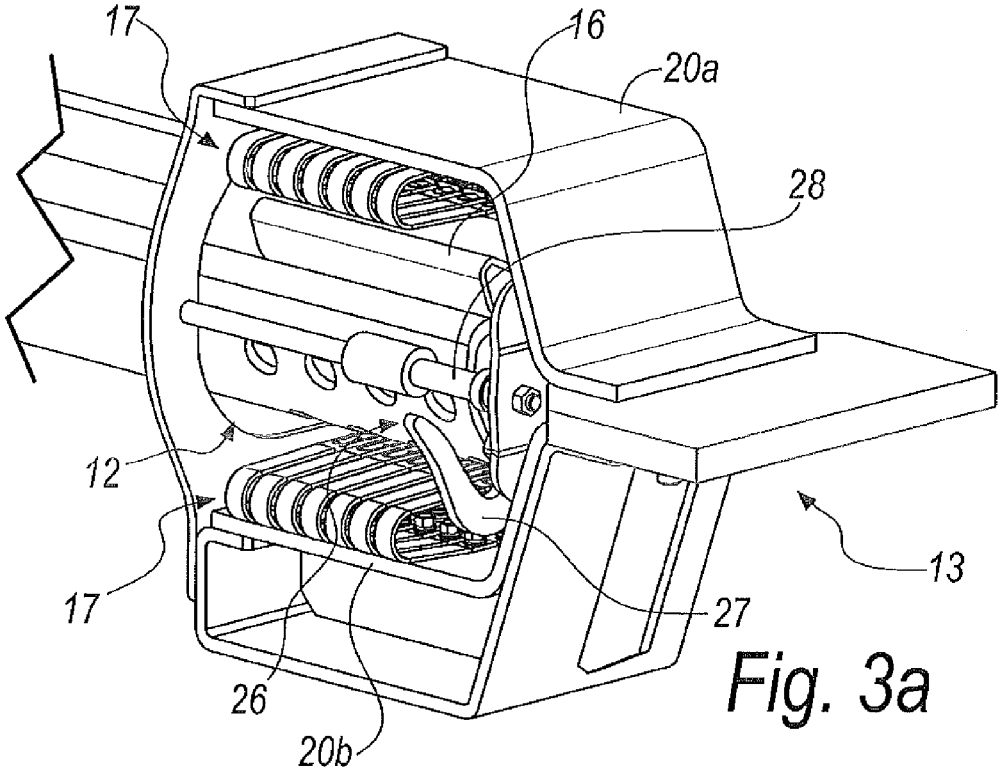
FIG. 3*a* is a perspective view of a detail of a disconnector according to the invention in an engagement configuration and in an uncoupling arrangement.
Figure 3B:
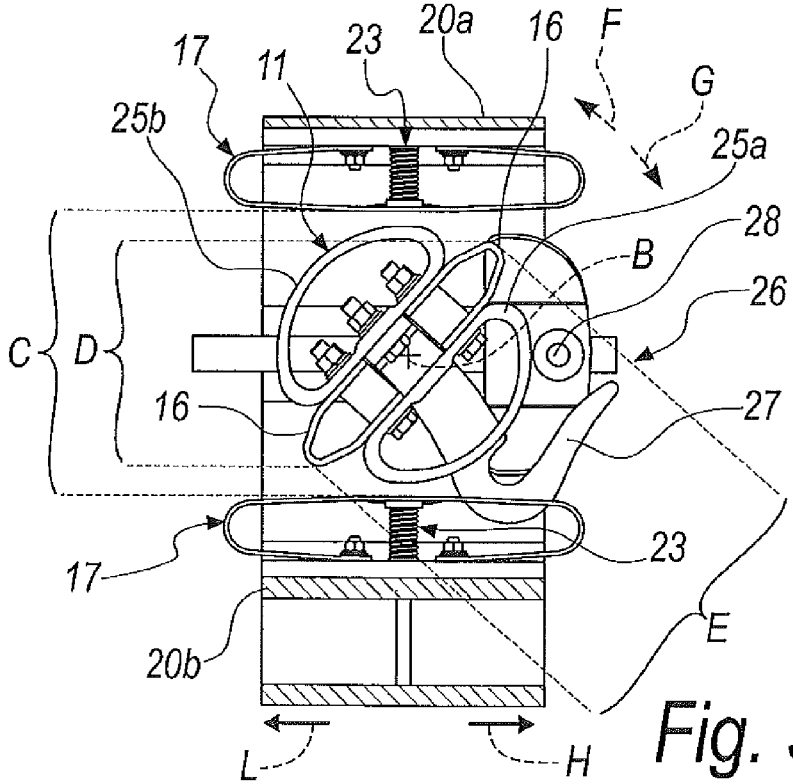
FIG. 3*b* is a transverse sectional view of the detail of FIG. 3*a* of a disconnector according to the invention.
Figure 3D:
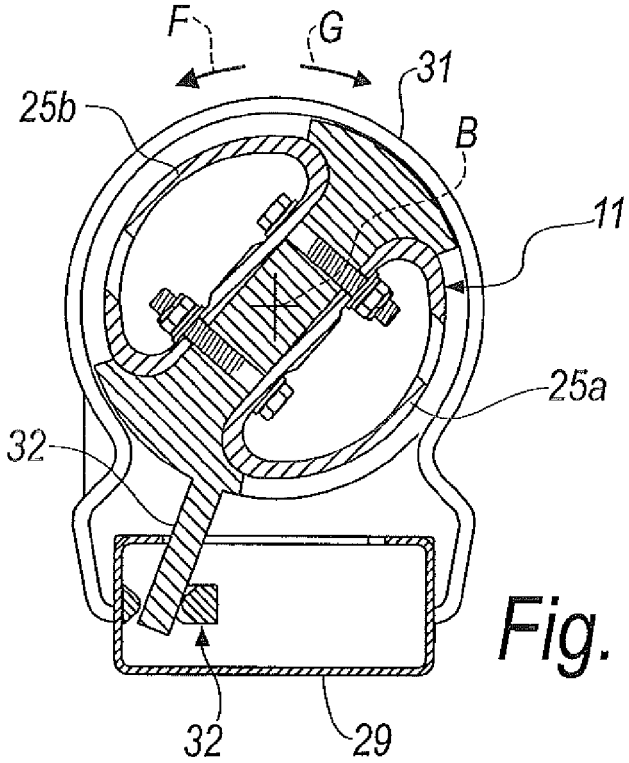
FIG. 3*d* is another partially sectional view of a detail of a disconnector according to the invention in an engagement configuration and in an uncoupling arrangement.
Figure 3C:
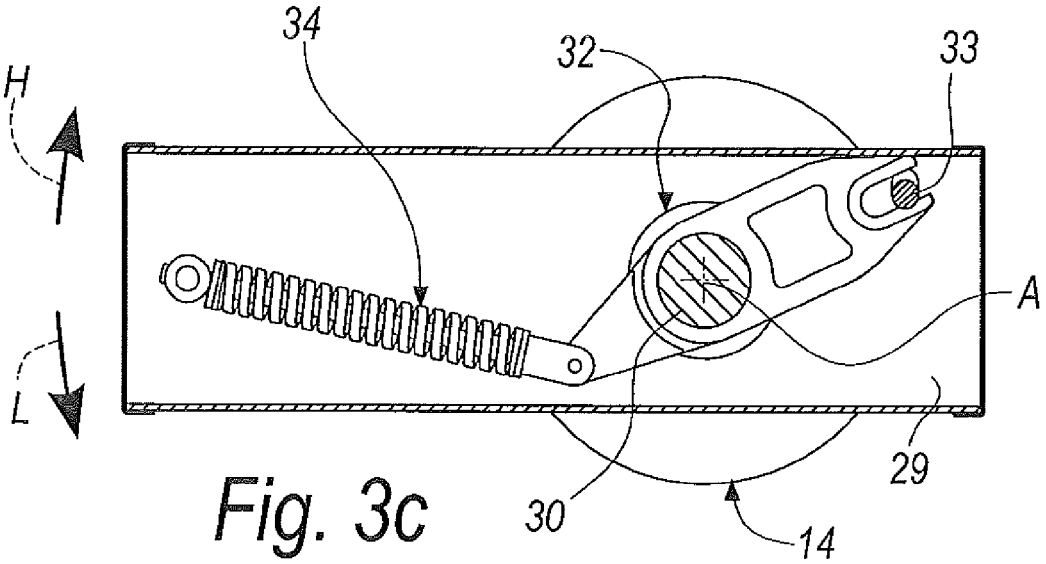
FIG. 3*c* is a partially sectional view of a further detail of a disconnector according to the invention in an engagement configuration and in an uncoupling arrangement.

Advantageously, a first group 22*a* and a second group 22*b* of the fixed contacts 17 face each other and are connected correspondingly to the facing supporting arms 20*a* and 20*b* of the sockets 13, so as to form an interspace C, which is estimated in the direction of the first rotation axis A, that is greater than the space occupation in uncoupling D, estimated in the direction of the first rotation axis A, from the pins 12 when they are in such uncoupling arrangement, as shown for example by way of non-limiting example in FIG. 3*b*.

Figure 4A:
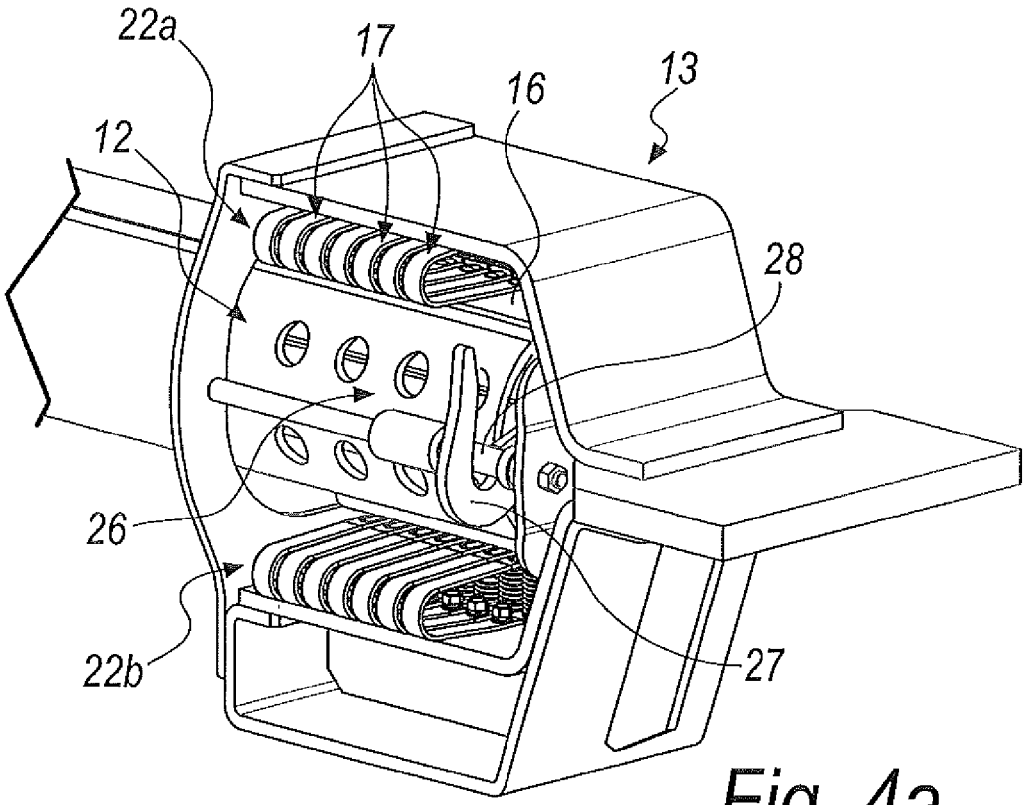
FIG. 4*a* is a perspective view of a detail of a disconnector according to the invention in an engagement configuration and in a coupling arrangement.
Figure 4B:
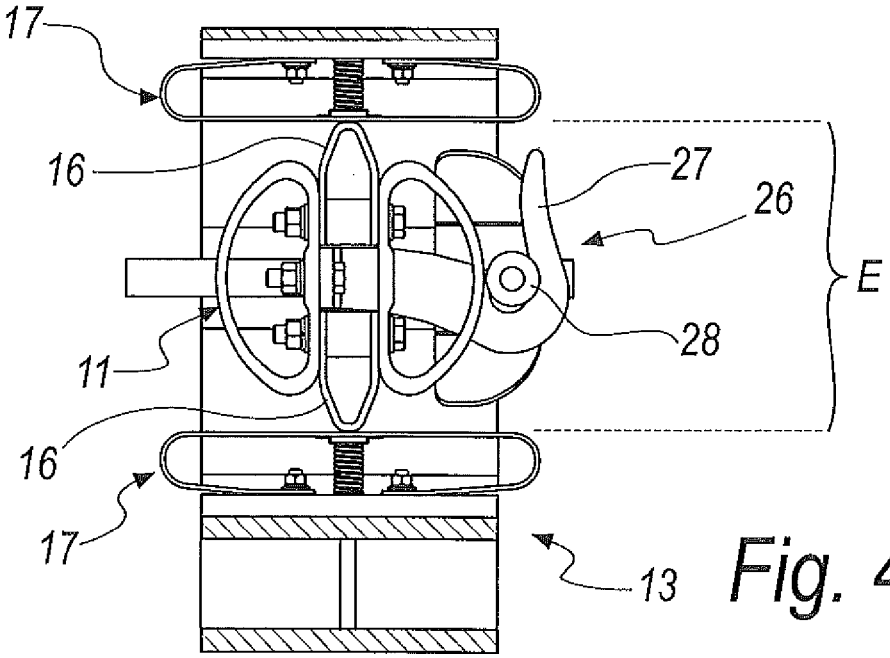
FIG. 4*b* is a transverse sectional view of the detail of FIG. 4*a* of a disconnector according to the invention.
Figure 4D:
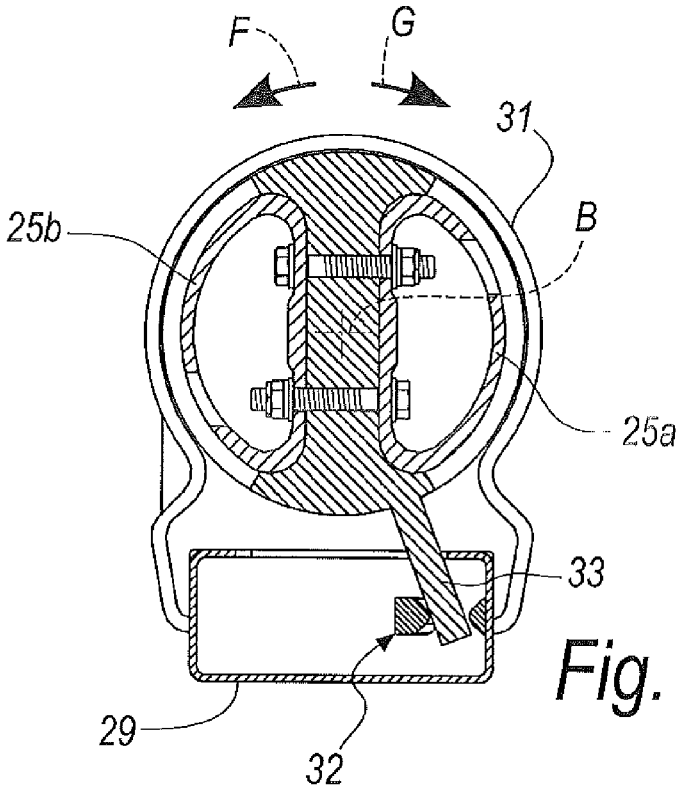
FIG. 4*d* is another partially sectional view of a detail of a disconnector according to the invention in an engagement configuration and in a coupling arrangement.
Figure 4C:
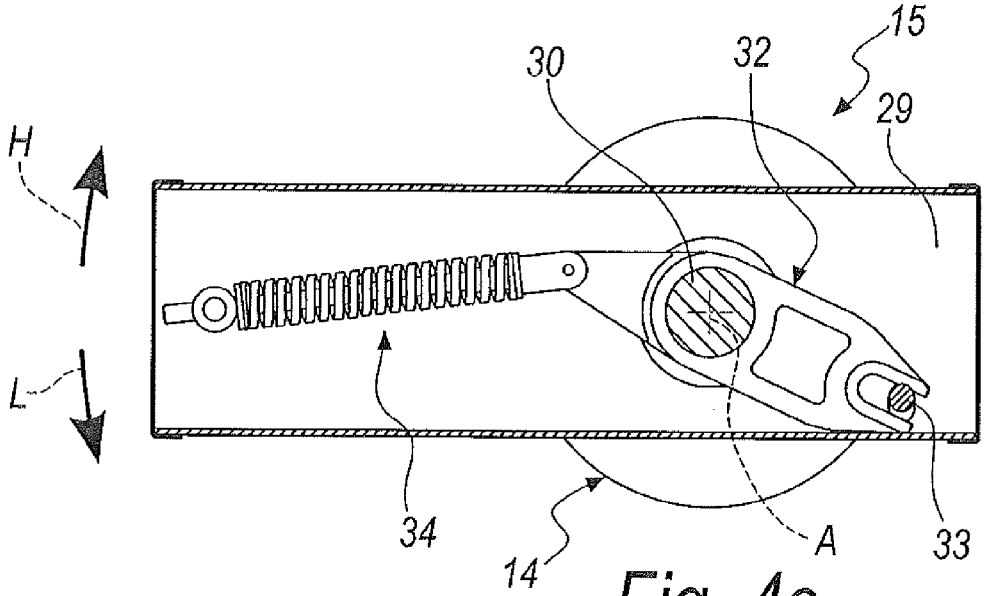
FIG. 4*c* is a partially sectional view of a further detail of a disconnector according to the invention in an engagement configuration and in an uncoupling arrangement.
Figure 5:
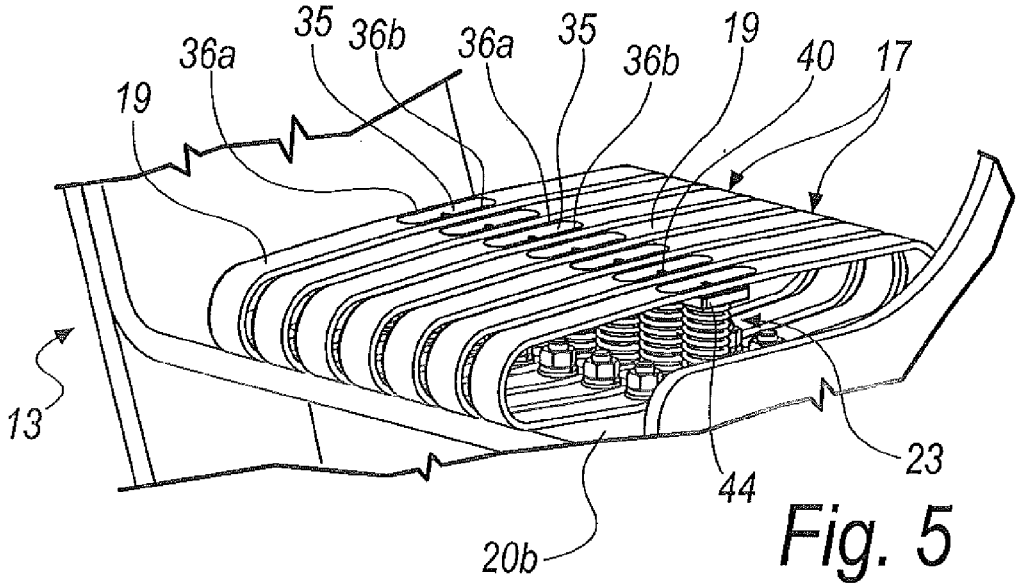
FIG. 5 is an enlarged-scale perspective view of a detail of a disconnector according to the invention.
Figure 6:
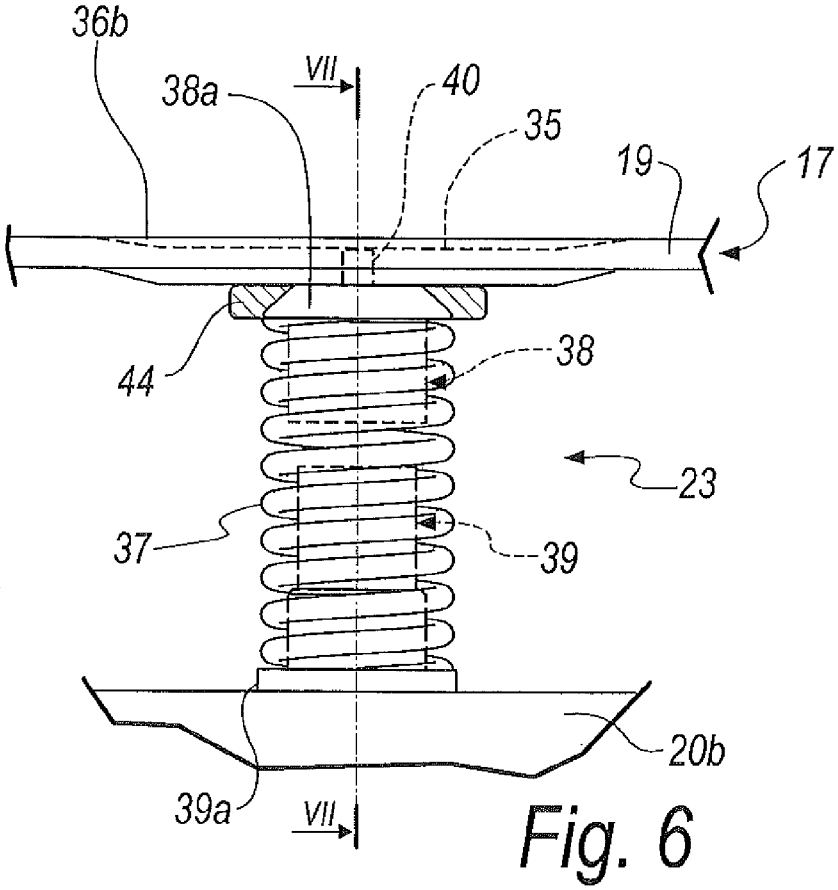
FIG. 6 is another enlarged-scale and partially sectional view of another detail of a disconnector according to the invention.
Figure 7:
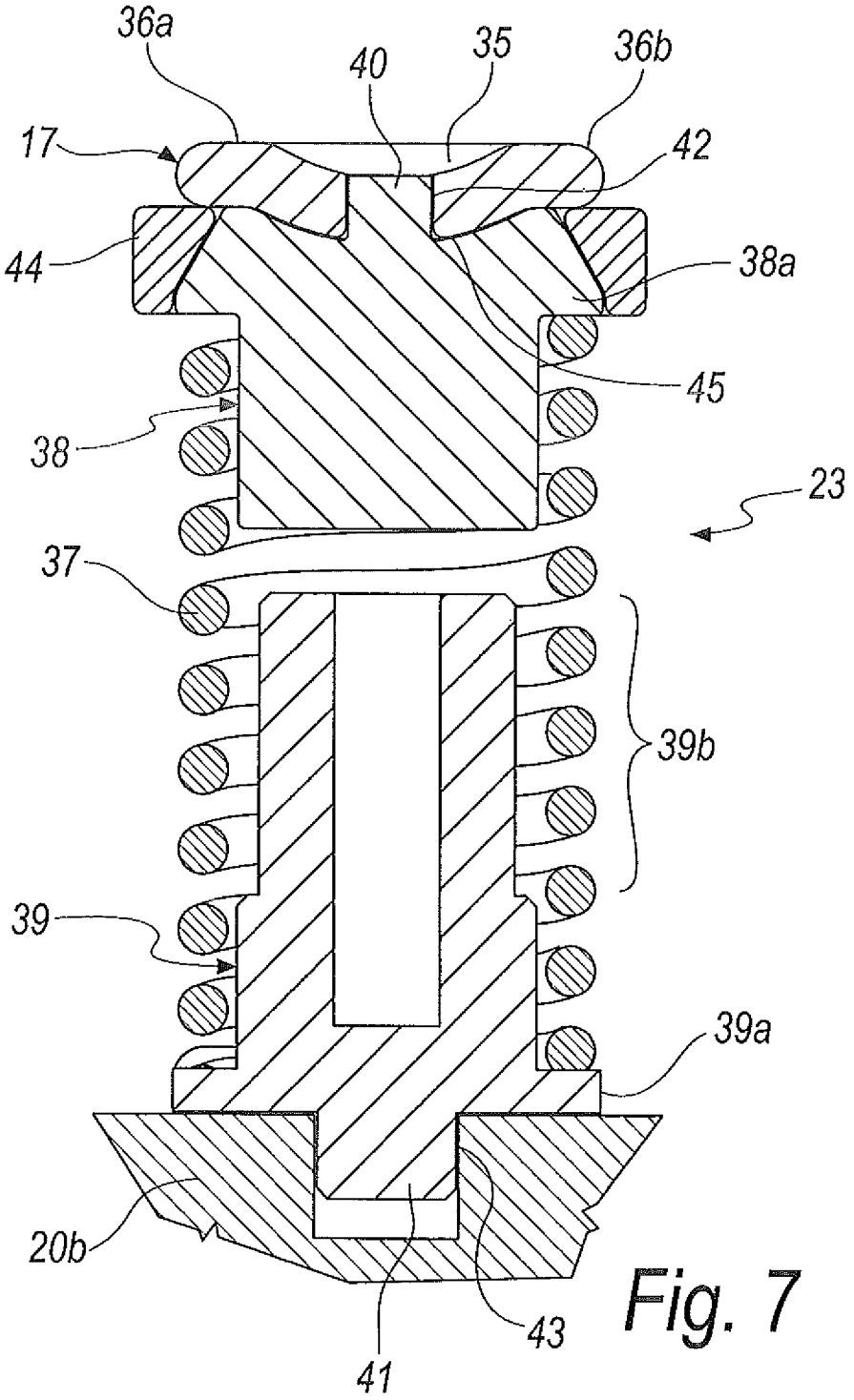
FIG. 7 is an enlarged and sectional view of a detail of a disconnector, according to the invention, taken along the line VII-VIII of FIG. 6.

Vice versa, as shown by way of non-limiting example in FIGS. 3*b* and 4*b*, the interspace C is smaller than the space occupation in coupling E, estimated in the direction of the first rotation axis A, with the pins 12 when they are in such coupling arrangement.

In such coupling arrangement, the fixed contacts 17 are deformed by elastic flexing by the moving contacts 16, as shown by way of non-limiting example in FIGS. 4*a* and 4*b*.

Preferably, elastic means 23 are provided for contrasting the flexing of the fixed contacts 17, which are insulated electrically or are insulating and are interposed between the supporting arms 20*a* and 20*b* and the fixed contacts 17 substantially at the intermediate portion 19.

In this manner, when the pins 12 rotate in the sockets 13 in order to couple, the moving contacts 16 slide against the fixed contacts 17, thus cleaning the respective contact surfaces, to the full benefit of an effective electrical contact.

The fixed contacts 17 are advantageously formed substantially like leaf springs, the conducting arms 21*a* and 21*b* being substantially mirror-symmetrical and having two bends 24*a* and 24*b* that are interposed between the intermediate portion 19 and the two regions 18*a* and 18*b* and connected to the supporting arms 20*a* and 20*b*.

The crossmember 11 conveniently comprises two tubular elements 25*a* and 25*b*, preferably made of aluminum, which are mutually adjacent and are adapted for electrical conduction between the pins 12, the moving contacts 16 being supported by the tubular elements 25*a* and 25*b* substantially at their ends.

The tubular elements 25*a* and 25*b* conveniently have a substantially D-shaped cross-section, being laterally adjacent at their substantially flat wall.

This shape of their cross-section and this arrangement of the tubular elements 25*a* and 25*b* allow to obtain that the crossmember has a high capacity for heat dissipation both by convection and by radiation and also allows to achieve a very uniform distribution of the conducted electrical current, to the full benefit of the quantity of current that can be conducted.

Conveniently, means 26 are provided for locking the pins 12 coupled in the sockets 13 and are active in such coupling arrangement and vice versa inactive in such uncoupling arrangement.

In particular, the locking means 26 comprise hooks 27, which protrude from the pins 12 radially with respect to the second rotation axis B, complementary hooking parts 28, which are jointly connected to the sockets 13 and are aligned with the hooks 27 along a trajectory that is circumferential with respect to the second rotation axis B when the crossmember 11 is in such engagement configuration.

Conveniently, in such coupling arrangement the hooks 27 are hooked to the complementary hooking parts 28, as shown by way of non-limiting example in FIGS. 4*a* and 4*b*.

Vice versa, in such uncoupling arrangement the hooks 27 are unhooked from the complementary hooking parts 28, as shown by way of non-limiting example in FIGS. 3*a* and 3*b*.

The rotation means 15 advantageously comprise a base 29, which is connected to an actuation shaft 30 rotatably about the first rotation axis A, which is defined by the axis of the actuation shaft 30, supports 31 for guiding the rotation of the crossmember 11, which are jointly connected to the base 29, form the second rotation axis B and support the crossmember 11 so that it can rotate about the second rotation axis B, a lever 32, which is jointly connected to the actuation shaft 30 and is transverse thereto and connected to a bar 33 that is jointly connected to the crossmember 11, means 34 for contrasting the rotation of the base 29 with respect to the lever 32, which are are elastically flexible and are interconnected between the lever 32 and the base 29.

The function of the lever 32 conveniently consists in driving, by means of the bar 33, the rotation of the crossmember 11 about the second rotation axis B in order to actuate the coupling or uncoupling of the pins 12 with respect to the sockets 13.

This rotation of the crossmember 11 about the second rotation axis B in a coupling direction F or in an uncoupling direction G is actuated when the base 29 is locked in the direction of rotation of the lever 32.

When the pins 12 are in such engagement configuration, as shown by way of non-limiting example in FIGS. 3*a* and 3*b*, the rotation of the base 29 is conveniently locked in an engagement direction H of rotation about the first rotation axis A, because the pins 12 are, in this direction of rotation, locked by the sockets 13, and therefore in this direction the crossmember 11 is locked and, with respect to the base 29, cannot rotate relative to the first rotation axis A.

A rotational overtravel of the actuation shaft 30 in the engagement direction H therefore causes a corresponding rotation of the lever 32, which is jointly connected thereto, with respect to the base 29, in contrast with the contrast means 34.

Thus, the lever 32 turns the bar 33 about the second rotation axis B, in the coupling direction F, and the crossmember 11 and the hooks 27 that it supports rotate with it.

Thus, the hooks 27 engage the complementary hooking parts 28, anchoring the pins 12 to the sockets 13, and the moving contacts 16 engage the fixed contacts 17, sliding on their intermediate portion 19 and deforming the fixed contacts 17 in contrast with the elastic means 23.

In this manner, the disconnector 10 has the pins 12 in such engagement configuration in such arrangement for coupling in the sockets 13, as shown by way of non-limiting example in FIGS. 4*a*, 4*b*, 4*c* and 4*d*.

Vice versa, if the actuation shaft 30 rotates from this arrangement, in which the pins 12 are engaged and mated in the sockets 13, in the disengagement direction L, such shaft, by means of the lever 32, actuates the rotation of the crossmember 11 in the uncoupling direction G.

In such arrangement, the rotation in the disengagement direction L of the base 29 is blocked by the hooks 27 that engage the complementary hooking parts 28, retaining the crossmember 11 to which the base is jointly connected with respect to rotations about the first rotation axis A.

Therefore, in this arrangement, the rotation of the actuation shaft 30 in the disengagement direction L is matched by a rotation of the lever 32 with respect to the base 29, in contrast with the contrast means 34, and this is matched by a rotation of the crossmember 11 by way of the action of the bar 33 actuated by the lever 32, in the uncoupling direction G until the pins 12 are moved into such uncoupling arrangement with respect to the sockets 13.

In such uncoupling arrangement, shown by way of non-limiting example in FIGS. 3*a*, 3*b*, 3*c* and 3*d*, the hooks 27 are free from the complementary hooking parts 28 and therefore the crossmember 11 is free to rotate in the disengagement direction L, supported by the base 29, which is rotated in such direction by the actuation shaft 30.

The fixed contacts 17 conveniently have, at the intermediate portion 19, a central depression 35, the lateral edges of which form two preferential regions of contact 36*a* and 36*b* between the fixed contacts 17 and the moving contacts 16.

The preferential contact regions 36*a* and 36*b* conveniently lie along the fixed contacts 17 substantially in the direction of friction of the moving contacts 16 during their coupling with the fixed contacts 17.

The elastic means 23 comprise a cylindrical compression spring 37, a first conducting cylindrical element 38, which is fitted into one end of the cylindrical spring 37 and a second electrically insulating cylindrical element 39, which is fitted into the other end of the cylindrical spring 37.

The cylindrical elements 38 and 39 have base flanges, designated respectively by the reference numerals 38*a* and 39*a*, which protrude from the ends of the cylindrical spring 37 and are interposed between them and respectively the supporting arms 20*a* and 20*b* and the fixed contacts 17.

Thus, the cylindrical elements 38 and 39 guide the cylindrical spring 37 in its compression and extension during the coupling and uncoupling of the pins 12 in the sockets 13 and in particular retain it in position in case of particular stresses, for example electrodynamic stresses such as due to a short circuit or for example due to seismic events, allowing it however to adapt in order to obtain an effective electrical contact between the fixed contact 17, which it presses against the moving contact 16 when the disconnector 10 is closed.

In particular, preferably the second cylindrical element 39 has an end portion 39*b*, which lies opposite the corresponding base flange 39*a*, which is narrower in order to guide the cylindrical spring 37 while allowing it a transverse deformation for adaptation in order to obtain an effective electrical contact between the fixed contact 17 and the moving contact 16 against which it presses it when the disconnector 10 is closed.

Moreover, conveniently the cylindrical elements 38 and 39 have respective centering pins 40 and 41, which are adapted to enter corresponding positioning holes 42 and 43 provided respectively in the fixed contact 17, conveniently in a central position with respect to the depression 35, and in the corresponding supporting arm 20*b*.

Moreover, conveniently there is an annular spacer 44, made of electrically insulating material, which is flared internally in order to find a seat on the base flange 38*a* of the first cylindrical element 38.

Furthermore, the base flange 38*a* and the annular spacer 44 fitted thereon are preferably conformed with respect to the back 45 of the fixed contact 17 at the depression 35.

The operation of the disconnector 10 according to the invention is as follows.

When it is closed, by means of the engagement and subsequent coupling of the pins 12 in the sockets 13, as described in detail above, the fixed contacts 17 are in electrical contact with the moving contacts 16, substantially at the preferential contact regions 36*a* and 36*b*.

Figure 2:
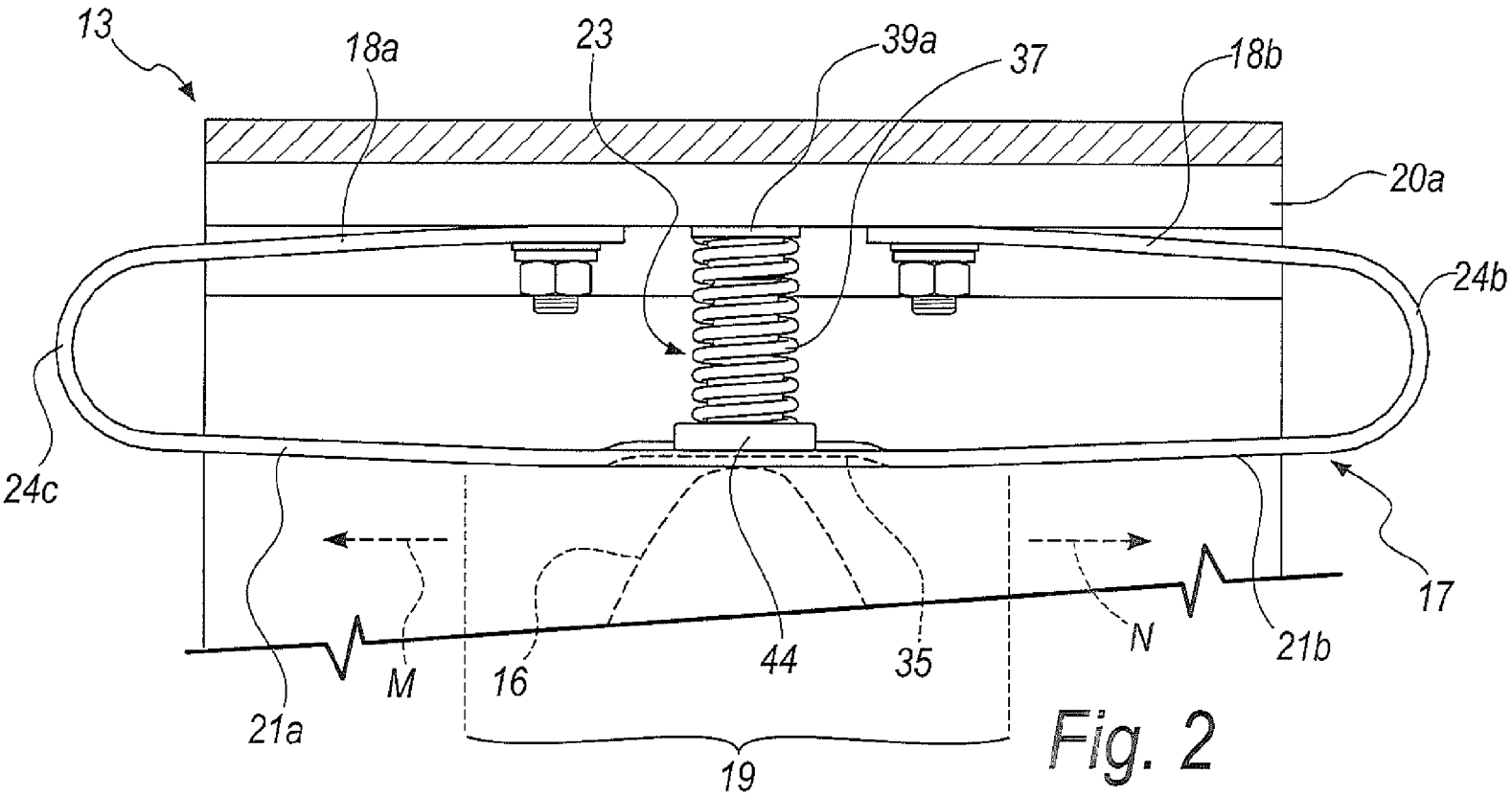
FIG. 2 is an enlarged-scale and partially sectional view of a detail of a disconnector according to the invention.

With particular reference to FIG. 2, the electrical current that passes from a moving contact 16 to a fixed contact 17 is split along the two conducting arms 21*a* and 21*b* into two flows of charges, shown schematically and merely by way of example by means of the arrows designated by the reference signs M and N.

The flows of charges M and N substantially have the same current intensity value if the two conducting arms 21*a* and 21*b* have substantially equal electrical resistivity values.

Thus, in the parts of the fixed contacts 17 that are upstream and downstream of the bends 24*a* and 24*b* the flows of charges M and N appear as opposite electrical currents, which therefore tend to divaricate the bends 24*a* and 24*b* of the fixed contacts 17, pushing the intermediate portion 19 against the moving contacts 16, which engage it, thus increasing the contact force between the fixed contacts 17 and the moving contacts 16.

Moreover, the total flow of charges carried by each fixed contact 17 is equal to the sum of the flows of charges M and N; however, each conducting arm 21*a* and 21*b* is crossed by an electrical current whose intensity is a part, substantially equal to half, of the current that corresponds to such total flow.

In this manner, with respect to the fixed contacts of currently known disconnectors, for equal conducted electrical current, nominally each conducting arm 21*a* and 21*b* of the fixed contacts 17 conducts an electrical current whose intensity is substantially halved with respect to the current that would be conducted in the same conditions of use by a fixed contact of a disconnector of the currently known type.

Moreover, in a disconnector according to the invention the fixed contacts allow to conduct effectively twice the electrical current than contacts of disconnectors of the known type with an equal extension of the conducting cross-section.

Thus, the reactance of the fixed contacts 17 of a disconnector 10 according to the invention is far smaller than the reactance of the fixed contacts of disconnectors of the currently known type, thus allowing to exceed the conducted current limitations that they currently have.

In practice it has been found that the invention achieves the intended aim and objects, providing a disconnector, particularly of the double-break double-movement type, that allows to conduct electrical currents with intensities even higher than 6000 A.

A disconnector according to the invention further allows effective and stable electrical connection between its pins and its sockets, also thanks to the electrodynamic effect produced by conduction through the fixed contacts, which are pushed against the moving contacts that engage them.

Moreover, a disconnector according to the invention has a durable efficiency also thanks to the contact cleaning effect provided by the mutual sliding during the coupling of the pins in the sockets.

Further, a disconnector according to the invention, when it does not disconnect the line, allows effective and efficient conduction of current across it.

Moreover, in a disconnector according to the invention the fixed contacts are arranged in an electrical parallel configuration, like the moving contacts, like the supporting arms of the fixed contacts and like the tubular elements, allowing to use a smaller quantity of material than the quantity to be used to provide a disconnector of a known type, for an equal current to be conducted, to the full advantage of savings particularly of copper, of which the fixed contacts and the moving contacts are preferably made.

The invention thus conceived is susceptible of numerous modifications and variations, all of which are within the scope of the appended claims; all the details may further be replaced with other technically equivalent elements.

In practice, the materials employed, so long as they are compatible with the specific use, as well as the contingent shapes and dimensions, may be any according to requirements and to the state of the art.

The disclosures in Italian Patent Application No. PD2010A000217 from which this application claims priority are incorporated herein by reference.

Where technical features mentioned in any claim are followed by reference signs, those reference signs have been included for the sole purpose of increasing the intelligibility of the claims and accordingly such reference signs do not have any limiting effect on the interpretation of each element identified by way of example by such reference signs.

The invention claimed is:

1. A disconnector comprising a crossmember, which has contact pins at opposite ends thereof, C-shaped contact sockets, which are aligned so as to correspond to said pins in order to receive them by insertion, along a trajectory that is circumferential with respect to a first rotation axis of said crossmember, which is substantially transverse thereto, a support of said crossmember that defines for it said first rotation axis, and a second rotation axis, which is substantially longitudinal to said crossmember, means for the rotation of said crossmember about said first rotation axis in order to drive the transition of said pins from a disengagement configuration to an engagement configuration in said sockets and vice versa, and about said second rotation axis in order to drive the transition of said pins from an uncoupling configuration to a coupling configuration of moving contacts of said pins with fixed contacts of said sockets, and vice versa, wherein each of said fixed contacts is connected electrically, in two separate end regions, to one of supporting arms that belong to said sockets, each of said fixed contacts having a portion that is intermediate with respect to said two regions and is adapted for contact with said moving contacts, said intermediate contact portion dividing said fixed contacts into two opposite conducting arms adapted to conduct electrical currents having a substantially equal intensity.

2. The disconnector according to claim 1, wherein a first group and a second group of said fixed contacts, connected to the facing supporting arms of said sockets, form an interspace, in the direction of said first rotation axis, that is greater than an uncoupling space occupation that said pins have in the direction of said first rotation axis when they are in said uncoupling arrangement, said interspace being smaller than a coupling space occupation that said pins have in the direction of said first rotation axis when they are in said coupling arrangement, said fixed contacts, in said coupling arrangement, being deformed by elastic flexing by said moving contacts.

3. The disconnector according to claim 2, further comprising elastic means for contrasting said flexing of said fixed contacts, which are electrically insulated or insulating and are interposed between said supporting arms and said fixed contacts substantially at said intermediate portion.

4. The disconnector according to claim 3, wherein said elastic means comprise a cylindrical compression spring, a first conducting cylindrical element, which is fitted into one end of said cylindrical spring, and a second electrically insulating cylindrical element, which is fitted into the other end of said cylindrical spring, said cylindrical elements having base flanges that protrude from said ends of said cylindrical spring and are interposed between them and respectively said supporting arms and said fixed contacts.

5. The disconnector according to claim 1, wherein said fixed contacts are shaped substantially like leaf springs, said conducting arms being substantially mirror-symmetrical and having two bends which are interposed between said intermediate portion and said two regions.

6. The disconnector according to claim 1, wherein said crossmember comprises two tubular elements arranged side by side and adapted for electrical conduction between said pins, said moving contacts being supported by said tubular elements substantially at their ends.

7. The disconnector according to claim 1, further comprising means for locking said pins in said sockets, said locking means being active in said coupling arrangement and vice versa inactive in said uncoupling arrangement.

8. The disconnector according to claim 7, wherein said locking means comprise hooks that protrude from said pins radially to said second rotation axis, complementary hooking parts, which are jointly connected to said sockets and are aligned with said hooks along a trajectory that is circumferential with respect to said second rotation axis when said crossmember is in said engagement configuration, in said coupling arrangement said hooks being engaged with said complementary hooking parts and vice versa in said uncoupling arrangement said hooks being disengaged from said complementary hooking parts.

9. The disconnector according to claim 1, wherein said rotation means comprise a base, which is connected to an actuation shaft so that it can rotate about said first rotation axis, which is defined by the axis of said actuation shaft, supports for guiding the rotation of said crossmember, which define said second rotation axis and support said crossmember so that it can rotate about said second rotation axis, said guiding supports being jointly connected to said base, a lever, which is jointly connected to said actuation shaft and is transverse thereto and connected to a bar that is jointly connected to said crossmember, in order to drive its rotation about said second rotation axis for the coupling or uncoupling of said pins with said sockets upon actuation of said lever when it rotates with respect to said base, means for contrasting the rotation of said base with respect to said lever, which are elastically flexible and interconnected between said lever and said base.

10. The disconnector according to claim 1, wherein said fixed contacts have, in said intermediate portion, a central depression, having lateral edges which form two preferential contact regions between said fixed contacts and said moving contacts, said preferential contact regions extending along said fixed contacts substantially in the direction of friction of said moving contacts during their coupling with said fixed contacts.

* * * * *